US010859248B2

(12) United States Patent
Xu et al.

(10) Patent No.: US 10,859,248 B2
(45) Date of Patent: Dec. 8, 2020

(54) LIGHT SOURCE MODULE AND LIGHTING DEVICE

(71) Applicant: OPPLE LIGHTING CO., LTD., Shanghai (CN)

(72) Inventors: Ziyu Xu, Shanghai (CN); Feng Li, Shanghai (CN); Xuejun Feng, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 29 days.

(21) Appl. No.: 16/386,106

(22) Filed: Apr. 16, 2019

(65) Prior Publication Data

US 2019/0242563 A1 Aug. 8, 2019

Related U.S. Application Data

(63) Continuation of application No. PCT/CN2017/106684, filed on Oct. 18, 2017.

(30) Foreign Application Priority Data

Oct. 26, 2016 (CN) ..... 2016 1 0948264
Oct. 26, 2016 (CN) ..... 2016 2 1172409 U
(Continued)

(51) Int. Cl.
*F21V 23/02* (2006.01)
*F21V 23/04* (2006.01)
(Continued)

(52) U.S. Cl.
CPC ..... *F21V 23/023* (2013.01); *F21S 8/04* (2013.01); *F21V 5/04* (2013.01); *F21V 5/046* (2013.01);
(Continued)

(58) Field of Classification Search
CPC ..... F21S 8/04; F21V 17/164; F21V 21/03; F21V 23/023; F21V 36/02; F21V 5/046
See application file for complete search history.

(56) References Cited

U.S. PATENT DOCUMENTS

2002/0044435 A1* 4/2002 Pohlert ..... H05B 45/20 362/13
2005/0225980 A1* 10/2005 Amphlett ..... G03B 15/03 362/244
(Continued)

FOREIGN PATENT DOCUMENTS

CN 204372729 U 6/2015
CN 105180092 A 12/2015
(Continued)

OTHER PUBLICATIONS

International Search Report (including English translation) and Written Opinion issued in PCT/CN2017/106684, dated Jan. 16, 2018, 13 pages.
(Continued)

*Primary Examiner* — Leah Simone Macchiarolo
(74) *Attorney, Agent, or Firm* — Arch & Lake LLP

(57) ABSTRACT

The present disclosure discloses a light source module and a lighting device. The light source module includes an annular light source substrate, which is enclosed to form a housing region, and the light source module further includes a plurality of light emitting units disposed on a surface of the light source substrate, a driving power component disposed in the housing region and electrically connected with the light source substrate, and a light distribution element. The light distribution element includes an annular optical portion covering the light source substrate, a drive housing portion housing the driving power component and disposed in the housing region, and at least two connection portions connecting the drive housing portion to the optical portion. The
(Continued)

at least two connection portions divide the housing region into at least two separated spaces.

19 Claims, 9 Drawing Sheets

(30) Foreign Application Priority Data

| | | |
|---|---|---|
| Oct. 26, 2016 | (CN) | 2016 2 1172410 U |
| Oct. 26, 2016 | (CN) | 2016 2 1172669 U |
| Oct. 26, 2016 | (CN) | 2017 1 0355726 |
| Oct. 26, 2016 | (CN) | 2017 2 0559722 U |
| Dec. 20, 2016 | (CN) | 2016 1 1187099 |
| Dec. 20, 2016 | (CN) | 2016 2 1402858 U |
| Apr. 28, 2017 | (CN) | 2017 2 0470482 U |

(51) Int. Cl.

| | |
|---|---|
| ***F21V 17/16*** | (2006.01) |
| ***F21V 21/096*** | (2006.01) |
| ***F21V 5/04*** | (2006.01) |
| ***F21S 8/04*** | (2006.01) |
| ***F21V 23/00*** | (2015.01) |
| *F21Y 115/10* | (2016.01) |
| *F21Y 105/18* | (2016.01) |
| *F21Y 103/33* | (2016.01) |

(52) U.S. Cl.

CPC ..... *F21V 17/164* (2013.01); *F21V 21/096* (2013.01); *F21V 23/006* (2013.01); *F21V 23/007* (2013.01); *F21V 23/045* (2013.01); *F21Y 2103/33* (2016.08); *F21Y 2105/18* (2016.08); *F21Y 2115/10* (2016.08)

(56) References Cited

U.S. PATENT DOCUMENTS

| | | | | |
|---|---|---|---|---|
| 2006/0215400 | A1* | 9/2006 | Lewis | G01N 21/8806 362/233 |
| 2011/0267827 | A1* | 11/2011 | Wein | F21S 8/02 362/368 |
| 2013/0044480 | A1* | 2/2013 | Sato | F21S 8/061 362/235 |
| 2013/0051010 | A1* | 2/2013 | Nakamura | G02B 3/0075 362/235 |
| 2014/0029252 | A1* | 1/2014 | Kato | F21V 23/002 362/235 |
| 2015/0176823 | A1* | 6/2015 | Leshniak | F21V 5/08 362/235 |
| 2020/0200378 | A1* | 6/2020 | Stokes | F21V 29/745 |
| 2020/0248898 | A1* | 8/2020 | Chen | F21V 23/0435 |

FOREIGN PATENT DOCUMENTS

| | | |
|---|---|---|
| CN | 105371125 A | 3/2016 |
| CN | 106369504 A | 2/2017 |
| CN | 206130761 U | 4/2017 |

OTHER PUBLICATIONS

First Office Action to Chinese Application No. 201710355726.0, dated Oct. 15, 2018, (7p).

Second Office Action to Chinese Application No. 201710355726.0, dated Mar. 21, 2019 with English translation, (16p).

Third Office Action to Chinese Application No. 201710355726.0, dated Aug. 6, 2019 with English translation, (17p).

* cited by examiner

LIGHT SOURCE MODULE AND LIGHTING DEVICE

CROSS-REFERENCE TO RELATED APPLICATIONS

This application is based upon and claims the priority of PCT patent application No. PCT/CN2017/106684 filed on Oct. 18, 2017 which claims the priority of Chinese Patent Application No. 201611187099.6 filed on Dec. 20, 2016, Chinese Patent Application No. 201710355726.0 filed on Oct. 26, 2016, Chinese Patent Application No. 201621172669.X filed on Oct. 26, 2016, Chinese Patent Application No. 201621402858.1 filed on Dec. 20, 2016, Chinese Patent Application No. 201720470482.6 filed on Apr. 28, 2017, Chinese Patent Application No. 201610948264.9 filed on Oct. 26, 2016, Chinese Patent Application No. 201621172410.5 filed on Oct. 26, 2016, Chinese Patent Application No. 201621172409.2 filed on Oct. 26, 2016, and Chinese Patent Application No. 201720559722.X filed on Oct. 26, 2016, the entire content of all of which is hereby incorporated by reference herein for all purposes.

TECHNICAL FIELD

The present disclosure belongs to a technical filed of lighting, and particularly relates to a light source module and a lighting device.

BACKGROUND

With the rapid development of lighting technology, a ceiling lamp is more and more widely used in indoor lighting. However, a light source and a driving power component in an existing lighting fixture are often separate components, which need to be separately assembled to the lighting fixture and then installed on the indoor ceiling. When the light source or the driving power source is damaged and needs to be replaced, the above components are not easily detached from the shell of the lighting fixture or assembled into the shell again.

SUMMARY

The present disclosure provides a light source module.

According to one aspect of the present disclosure, a light source module is provided, which includes: an annular light source substrate; a plurality of light emitting units disposed on a surface of the light source substrate; a driving power component electrically connected with the light source substrate to supply power to the plurality of light emitting units where the driving power component includes a power substrate and a plurality of electronic components disposed on at least one surface of the power substrate; and a light distribution element, including an annular optical portion covering the light source substrate and distributing light beams emitted from the plurality of light emitting units, and a drive housing portion housing the driving power component.

According to another aspect of the present disclosure, a light source module is further provided, which includes: an annular light source substrate enclosed to form a housing region; a plurality of light emitting units disposed on a surface of the light source substrate; a driving power component disposed in the housing region and electrically connected with the light source substrate to supply power to the plurality of light emitting units, where the driving power component includes a power substrate and a plurality of electronic components disposed on at least one surface of the power substrate; and a light distribution element including an annular optical portion covering the light source substrate and distributing light beams emitted from the plurality of light emitting units, a drive housing portion housing the driving power component and disposed in the housing region, and at least two connection portions connecting the drive housing portion to the optical portion, where the at least two connection portions divide the housing region into at least two separated spaces.

According to still another aspect of the present disclosure, a light source module is further provided, which includes: an annular light source substrate enclosed to form a housing region; a plurality of light emitting units disposed on a surface of the light source substrate; a driving power component disposed in the housing region and electrically connected with the light source substrate to supply power to the plurality of light emitting units, where the driving power component includes a power substrate and a plurality of electronic components disposed on at least one surface of the power substrate; a light distribution element detachably assembled with the light source substrate and the driving power component, wherein the light distribution element includes an annular optical portion covering the light source substrate and distributing light beams emitted from the plurality of light emitting units, a drive housing portion housing the driving power component and disposed in the housing region, and at least two connection portions connecting the drive housing portion to the optical portion, where the at least two connection portions divide the housing region into at least two separated spaces.

It is to be understood that both the foregoing general description and the following detailed description are exemplary and explanatory only and are not restrictive of the present disclosure.

BRIEF DESCRIPTION OF THE DRAWINGS

The accompanying drawings described herein are intended to provide a further understanding of the present disclosure, and constitute a part of the disclosure, illustrative examples of the present disclosure and the description thereof are used to explain the present disclosure, and constitute no limitation to the present disclosure. In the accompanying drawings.

DETAILED DESCRIPTION

Figure 1:
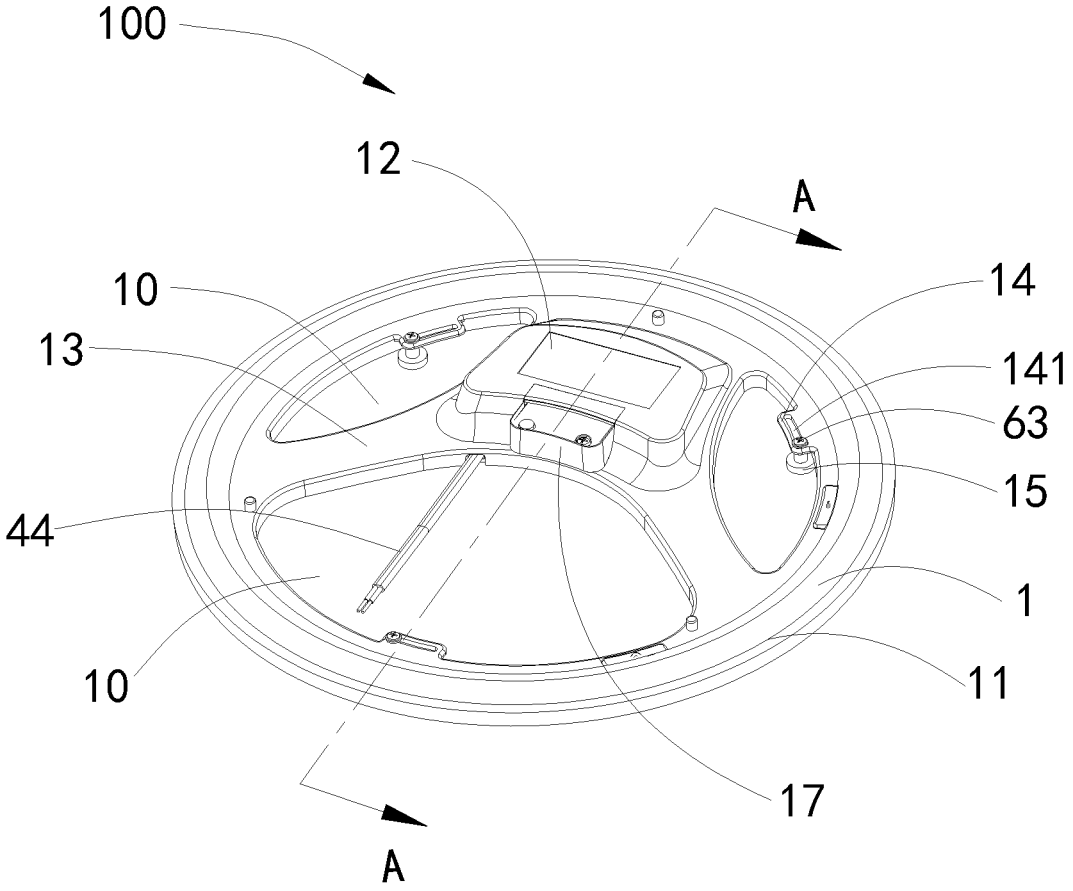
FIG. 1 is a perspective view of a light source module according to a first example of the present disclosure.

In order to make objects, technical details and advantages of the examples of the disclosure apparent, the technical solutions of the examples will be described in a clearly and fully understandable way in connection with the drawings related to the examples of the disclosure. Apparently, the described examples are just a part but not all of the examples of the disclosure. Based on the described examples herein, those skilled in the art can obtain other example(s), without any inventive work, which should be within the scope of the disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference numerals shown in FIG. 1 to FIG. 10 are: light source module 100, 100*a*, 100*b*; lens 1, 1*a*, 1*b*; separated space 10; edge portion 11, 11*a*, 11*b*; recessed groove 111; bottom surface 112; upper surface 113; third opening 114*a*, 114*b*; intermediate portion 12, 12*a*, 12*b*; protruding portion 121; housing groove 1211; first opening 122; second opening 123; connection portion 13, 13*a*, 13*b*; mounting portion 14; mounting hole 141; magnetic mounting element 15; joint portion 151; adsorption portion 152; snap 16; capping 17, 17*a*, 17*b*; light source substrate 2, 2*a*, 2*b*; first substrate 201*b*; second substrate 202*b*; third substrate 203*b*; substrate unit 21; third wire 22; light source portion opening 23*a*, 23*b*; light emitting unit 3, 3*a*, 3*b*; driving power component 4, 4*a*, 4*b*; power substrate 41; connector 42; first wire 43; second wire 44; cover plate 5, 5*a*, 5*b*; first screw 61, 61*a*, 61*b*; second screw 62, 62*a*, 62*b*; third screw 63.

An integrated light source module has developed, that is, the light source and the driving power are integrated to facilitate replacement of them. However, sometimes, such integrated light source module may have a complicated structure and a poor structural strength, and the integrated light source module may be damaged easily and may be inconvenient to install.

As shown in FIG. 1 to FIG. 6, the present example provides a light source module 100 applied to a lighting device (not shown). Specifically, the light source module 100 includes a lens 1, a light source substrate 2 assembled on a side of the lens 1, a plurality of light emitting units 3 disposed on the light source substrate 2 and facing the lens 1, and a driving power component 4 disposed in the lens 1. Specifically, the light source substrate 2 has an annular shape, and the light source structure 2 is enclosed to form a housing region. It should be noted that the light source module 100 can achieve an illumination effect required by the lighting device, that is, the light source module 100 can achieve that the lighting device has an illumination effect of a certain illumination range and a uniform luminous brightness. Preferably, the lighting device as mentioned above can be a ceiling lamp (not shown) for indoor lighting, which includes a chassis and a mask connected to the chassis, and the light source module 100 is disposed in a space formed by the connection of the chassis and the mask. Hereinafter, the specific structure of each component in the light source module 100 will be described in detail.

Figure 6:
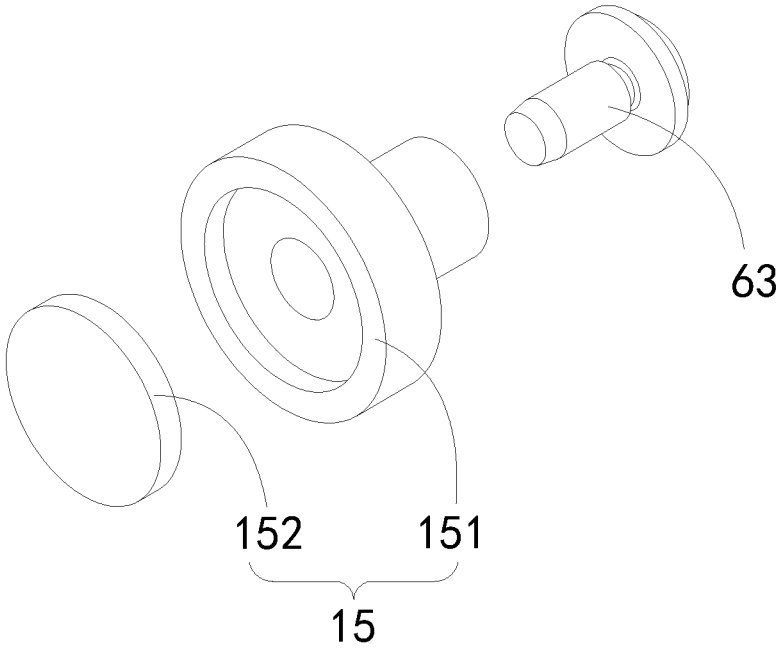
FIG. 6 is an exploded view of a magnetic mounting element and a screw of a light source module according to a first example of the present disclosure.

As shown in FIG. 1 and FIG. 6, the lens 1 in the light source module 100 is used for a secondary light distribution of light beams emitted from the light emitting unit 3, that is, the light source module is used for optical path adjustment. In the present example, the lens 1 can be made of a transparent plastic material having an optical property (for example, PC, PMMA), and can be integrated by injection molding technology. In other alternative examples, the lens 1 can be made of glass. In other alternative examples, the lens 1 can be a transparent glass casing with a uniform thickness, which only has a light transmission function and a connection function, and has no light distribution function.

Hereinafter, the structure of the light source module 100 will be further described in detail.

As shown in FIG. 1 to FIG. 6, the lens 1 is a light distribution element, which has a substantially circular shape, and includes an annular edge portion 11, an intermediate portion 12 that is closely attached to the inner side of the edge portion 11, and two connection portions 13 connecting the edge portion 11 and the intermediate portion 12.

Figure 2:
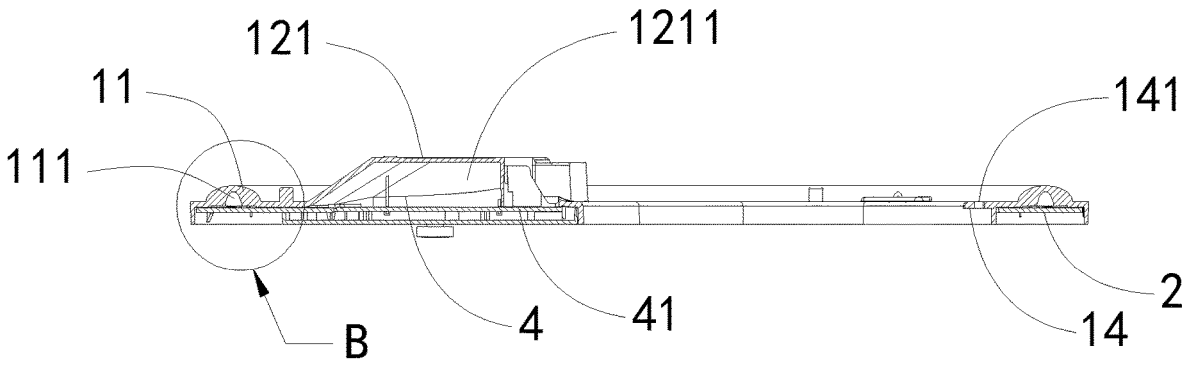
FIG. 2 is a cross-sectional view taken along a direction A-A of FIG. 1.
Figure 3:
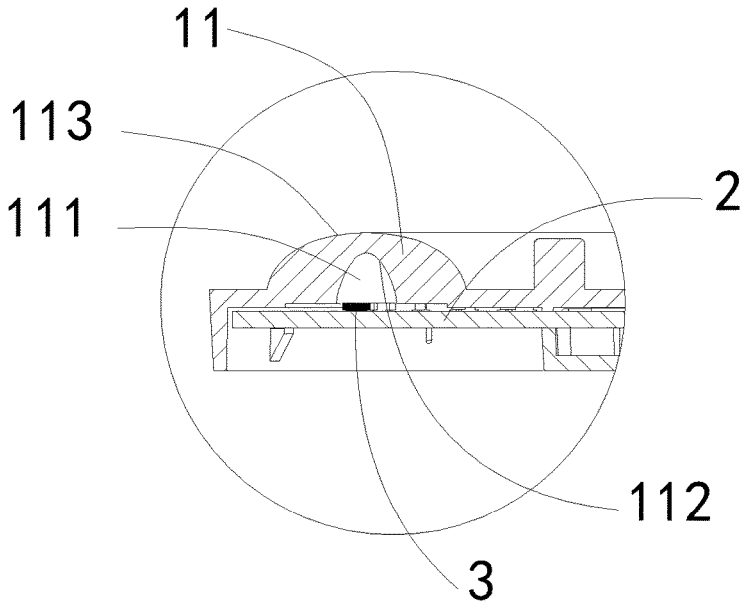
FIG. 3 is a local enlarged view of a position B in FIG. 2.
Figure 5:
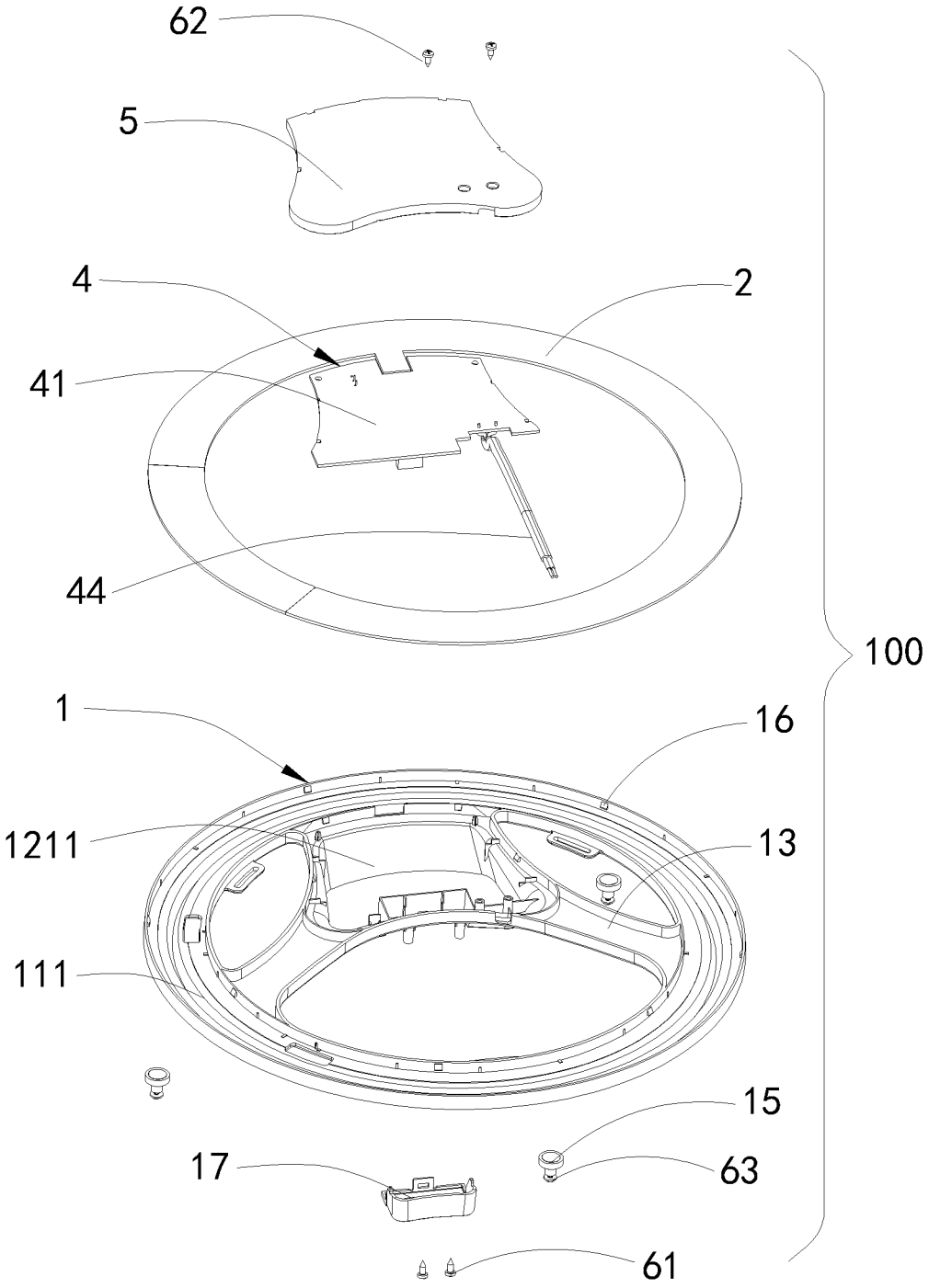
FIG. 5 is an exploded view of another direction of a light source module according to a first example of the present disclosure.

As shown in FIG. 2, FIG. 3 and FIG. 5, specifically, the edge portion 11 is an optical region for light distribution on the lens 1, covers the light source substrate 2 and distributes the light beams emitted from the light emitting unit 3. A lower surface of the edge portion 11 is provided with a recessed groove 111, the plurality of light emitting units 3 can be disposed in the recessed groove 111. Therefore, the recessed groove can also be referred to as a light source housing groove. At the same time, an edge of the lower surface of the edge portion 11 is provided with a plurality of snaps 16 for fixing the light source substrate 2, and a shape of each cross section of the edge portions 11 in an extending direction thereof is identical. As shown in FIG. 3, the recessed groove 111 has a bottom surface 112 appearing as an arched curved surface, and the bottom surface 112 is a light incident surface. The edge portion 11 has an upper surface 113 appearing as an arched curved surface, the upper surface 113 is a light exiting surface. Further, a curvature of the light incident surface is greater than a curvature of the light exiting surface, that is, the light incident surface is more curved than the light exiting surface.

As shown in FIG. 1, FIG. 2, FIG. 4 and FIG. 5, the intermediate portion 12 is a drive housing region on the lens 1 for housing the driving power component 4, and has a substantially square shape. A part of the intermediate portion is arched upward from a lower surface thereof to form a protruding portion 121, at the same time, the protruding portion 121 is provided with a housing groove 1211 for housing the driving power component 4.

Figure 4:
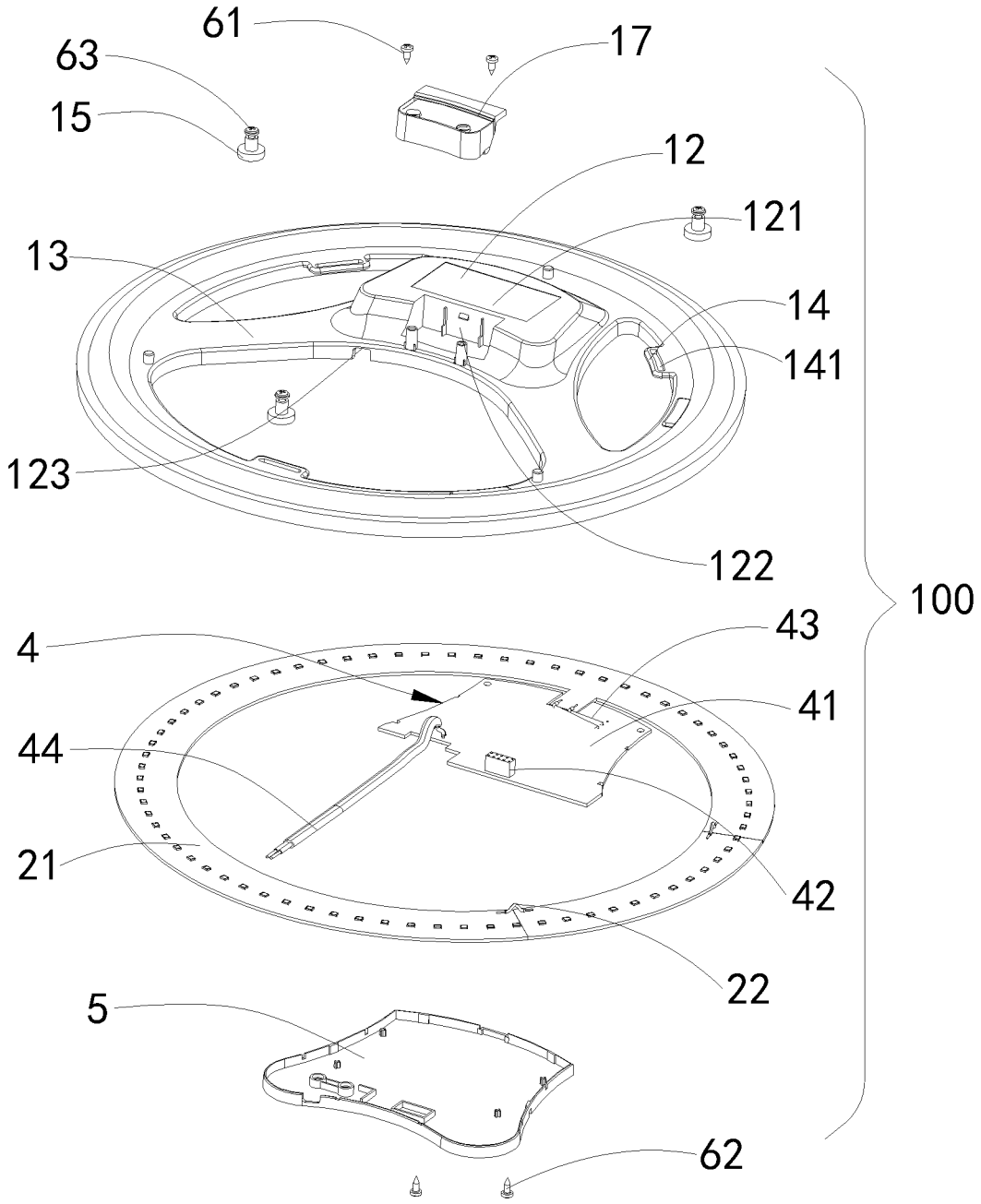
FIG. 4 is an exploded view of a light source module according to a first example of the present disclosure.

As shown in FIG. 4, the intermediate portion 12 is further provided with a first opening 122, and a capping 17 for sealing the first opening 122 is mounted on the first opening 122, and the capping 17 is locked to the intermediate portion 12 by a first screw 61 to seal the first opening 122, so as to prevent dust from falling into the intermediate portion 12. A position corresponding to the first opening 122 can be used to mount a control module (not shown). It should be noted that the control module can include, for example, a receiving element for receiving a signal from a remote controller or a control terminal, a timer for controlling timing of lighting for the lighting device, etc. After the control module is mounted, the first opening 122 is sealed by the control module, and at this time, the capping 17 may no longer be mounted.

As shown in FIG. 1, FIG. 4 and FIG. 5, the intermediate portion 12 has two apical angle regions formed by an intersection of two adjacent sides, each connection portion 13 extends from the apical region of the intermediate portion 12 to the inner side of the edge portion 11. The connection portion 13 has a flat strip shape and is transparent. It should be noted that the light source substrate 2 can further include a portion extending into the connection portion 13, and the connection portion 13 serves as an optical region for distributing light. Of course, each connection portion 13 can also be translucent or opaque, in which case the connection portion 13 is only used as a connection function.

Further, as shown in FIG. 4 and FIG. 5, the intermediate portion 12 and the connection portion 13 divide the region enclosed by the annular edge portion 11 into three separated spaces 10, and the separated spaces 10 allow the user who disassembles or assembles the light source module 100 to hold the light source module 100 easily. In other examples, one intermediate portion 12 and two connection portions 13 may be provided to divide the housing region enclosed by the annular light source substrate 2 into two separated spaces, or when the number of the connection portions 13 is n (where n is greater than 2), the housing region is divided into n or n+1 separated spaces. The arrangement of the connection portion 13 not only enhances the structural strength of the light source module 100, but also allows the light distribution by the connection portion 13 or disposing a mounting portion 14 on the connection portion 13 for positioning and mounting, when necessary. An inner side of the edge portion 11 is uniformly provided with three mounting portions 14 having a shape of an arc along a circumferential direction thereof. The mounting portion 14 extends from the inner edge of the edge portion 11 into the housing region, and the three mounting portions 14 are respectively provided with a curved mounting hole 141. As shown in FIG. 1 and FIG. 6, the light source module 100 further includes a magnetic mounting element 15 that is locked to the mounting portion 14 by a third screw 63 passing through the mounting hole 141. A head of the third screw 63 and the magnetic mounting element 15 are respectively located on both sides of the mounting portion 14, and the magnetic mounting element 15 is position adjustably mounted on the mounting portion 14 through the curved mounting hole 141. The magnetic mounting element 15 includes a joint portion 151 and an adsorption portion 152, one end of the joint portion 151 is connected to the third screw 63, the other end of the joint portion 151 is provided with a circular groove (not shown), the adsorption portion 152 is housed in the groove, and the adsorption portion 152 is a strong magnet. In the present example, the three magnetic mounting elements 15 are respectively located in different separated spaces 10. A mounting board of the ceiling lamp is usually made of metal and can be pre-installed on a mounting base such as a ceiling. When the light source module 100 is installed, the magnetic mounting element 15 is just needed to be adjusted to a proper position, then the third screw 63 is tightly locked to the mounting portion 14, so that the magnetic mounting element 15 will not move, and then the magnetic mounting element 15 is adsorbed on the mounting board of the ceiling lamp. Therefore, the light source module 100 can be installed on the mounting base. The installation method of the light source module 100 is simple and convenient, and connections thereof are reliable. Of course, in other alternative examples of the present disclosure, the number of the mounting portions 14 can be other values, such as four or five or more. In addition, the shape of the lens 1 is merely illustrative, and is not limited to a circular shape, and can also be an elliptical shape, a triangular shape, a square shape, a rectangular shape, a hexagonal shape, an octagonal shape, etc.

As shown in FIG. 4 and FIG. 5, the light source substrate 2 can be a printed circuit board, which has conductive wires. The configuration of the light source substrate 2 on the horizontal surface is approximately the same as that of the lens 1, and has an annular shape. The light source substrate 2 is fixed on the edge portion 11 by the snap 16 on the edge portion 11. The light source substrate 2 has a shape of an integral circular ring or an annular shape formed by connecting a plurality of substrate units 21 having a curved shape. When the plurality of substrate units 21 are connected, two adjacent substrate units 21 can be electrically connected through a third wire 22, and be driven by one driving power component 4 at the same time. In other alternative examples, the plurality of substrate units 21 may not be connected by the third wire 22, but be respectively driven by a corresponding driving power source (not shown). The light source substrate 2 can further include a portion (not shown) disposed in the connection portion 13, on which the plurality of light emitting units (not shown) are disposed. Or, when the light source substrate 2 and the driving power component 4 are separately disposed, wires can be routed inside the connection portion 13.

As shown in FIG. 2, FIG. 4 and FIG. 5, the driving power component 4 is disposed in the housing groove 1211, and includes a power substrate 41 and a plurality of electronic components disposed on one surface or both surfaces of the power substrate 41. The plurality of electronic components include, but are not limited to, a driver controller chip, a rectifier chip, a resistor, a capacitor, a fuse, a coil, etc., and the plurality of electronic components are disposed on the power substrate 41 in a form of surface attaching or socketing. The power substrate 41 and the light source substrate 2 are integrally or separately disposed, and the power substrate 41 is connected to the light source substrate 2 through a first wire 43. The power substrate 41 is also connected with a second wire 44 for connecting to an external power source, and the intermediate portion 12 is provided with a second opening 123 through which the second wire 44 passes.

As shown in FIG. 4, the power substrate 41 corresponding to the first opening 122 is further provided with a connector 42. The light source module 100 can further include a controller (not shown) disposed on the power substrate 41. The controller can be directly plugged into the connector 42, so that the controller is connected to the power substrate 41. The controller can includes a timer, a switch (not shown) for controlling the light emitting unit 3, a receiving element for receiving a signal such as Bluetooth, infrared, etc., from a remote controller or a control terminal. After the receiving element receives the signal, the controller controls the light emitting unit 3 to be turned on, turned off, and timing switched.

As shown in FIG. 4, the light source module 100 further includes a cover plate 5 mounted on the intermediate portion 12 and sealing the housing groove 1211. The cover plate 5 can be made of a transparent insulating material and fixed to the intermediate portion 12 through a second screw 62. In other alternative examples, the cover plate 5 can also be combined with the intermediate portion 12 and the edge portion 11 at the same time. A transparent material of the cover plate can be an insulating material such as polymethyl methacrylate (PMMA), polycarbonate (PC), polystyrene (PS), polyester resin (PET), or glycol modified polyester (PETG). The arrangement of the cover plate 5 can protect the driving power component 4, so as to make the driving power component 4 safer and dust-proof.

Referring to FIG. 2 and FIG. 3, the light emitting unit 3 is an LED unit, which can be installed on the upper surface of the light source substrate 2 by Surface Mount Technology (SMT) or Through Hole Technology (THT). The plurality of light emitting units 3 are electrically connected to each other through the conductive wires on the light source substrate 2. The plurality of light emitting units 3 are sequentially arranged along an extending direction of the light source substrate 2 or the edge portion 11. It should be noted that the plurality of light emitting units 3 are disposed below the edge portion 11 and correspond to the recessed groove 111, that is, the plurality of light emitting units 3 can be regarded as being housed inside the recessed groove 111. In addition, the light source module 100 emits light of uniform brightness by adjusting the size of rounded corners of the light source substrate 2 and the number of the light emitting units 3 at the rounded corners. Of course, in other alternative examples of the present disclosure, the plurality of light emitting units 3 can also be arranged in two or three or more rows.

Figure 7:
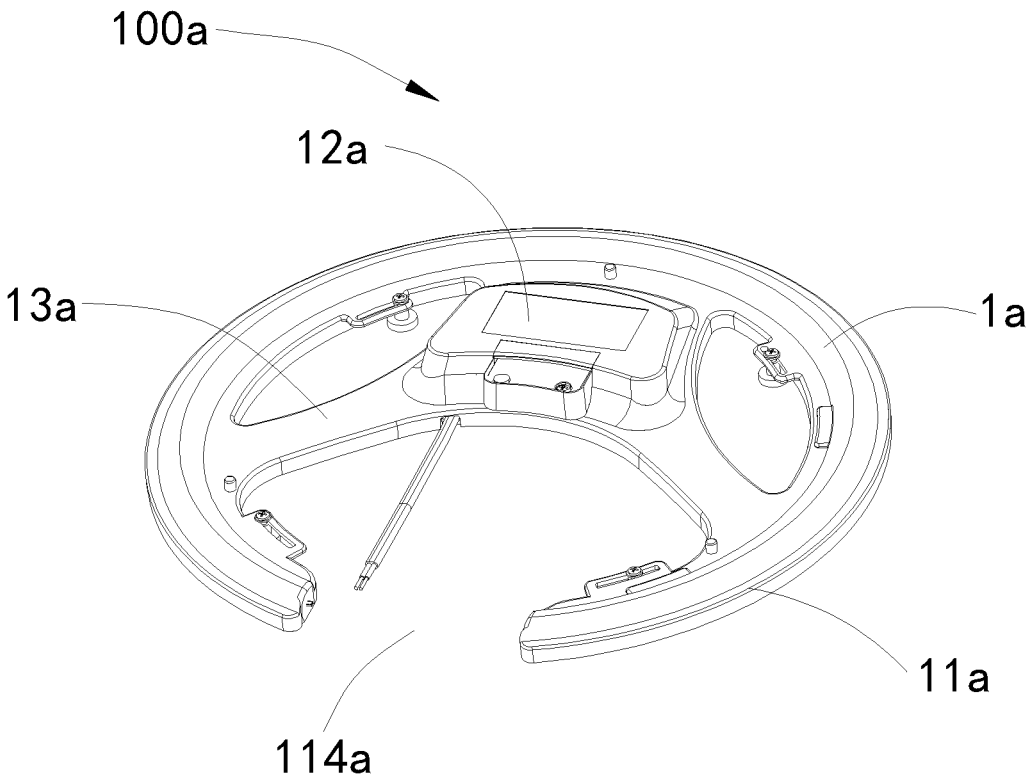
FIG. 7 is a perspective view of a light source module according to a second example of the present disclosure.
Figure 8:
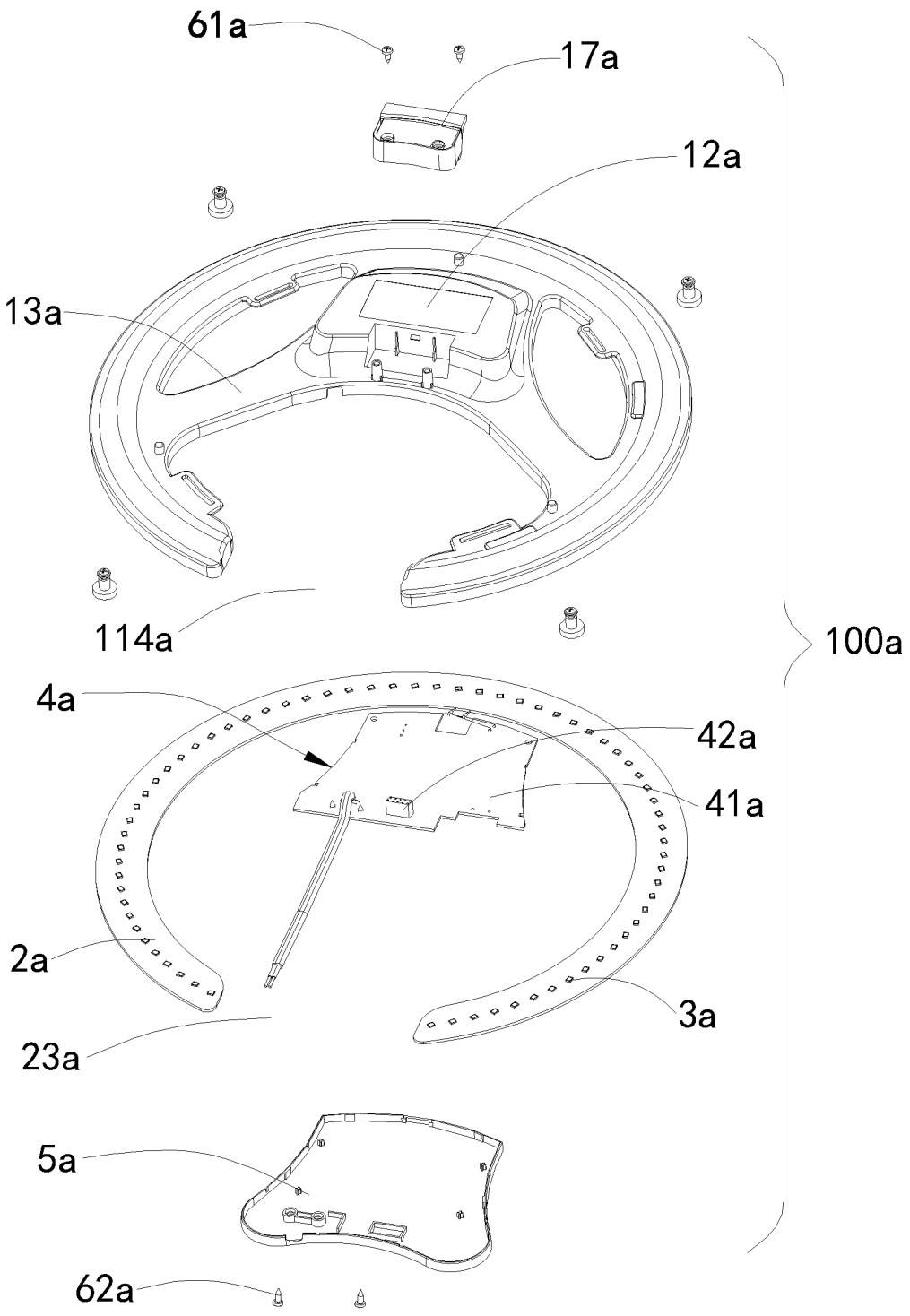
FIG. 8 is an exploded view of a light source module according to a second example of the present disclosure.

Referring to FIG. 7 and FIG. 8, a second example of the present disclosure provides a light source module 100*a* applied to a lighting device (not shown). The light source module 100*a* of the second example has substantially the same structure as the light source module 100 of the first example. Specifically, the light source module 100*a* includes a lens 1*a*, a light source substrate 2*a* assembled on a side of the lens 1*a*, a plurality of light emitting units 3*a* disposed on the light source substrate 2*a* and facing the lens 1*a*, and a driving power component 4*a* disposed in the middle of the lens 1*a*, a capping 17*a* connected to the lens 1*a* by a first screw 61*a* and a cover plate 5*a* connected to the lens 1*a* by a second screw 62*a*. Hereinafter, a structural difference between the light source module 100*a* of the second example and the light source module 100 of the first example will be described in detail.

As shown in FIG. 7 and FIG. 8, the lens 1*a* is substantially the same as the lens 1, and has a circular shape. The lens 1*a* includes an annular edge portion 11*a* having a third opening 114*a*, an intermediate portion 12*a* that is closely attached to the inner side of the edge portion 11*a*, and two connection portions 13*a* connecting the edge portion 11*a* and the intermediate portion 12*a*. The third opening 114*a* connects the inner and outer sides of the edge portion 11*a*. It should be noted that the same components of the lens 1*a* as those of the lens 1 will not be described herein. In addition, the shape of the lens 1 is merely illustrative, and is not limited to a circular shape, and can be an elliptical shape, a triangular shape, a square shape, a rectangular shape, a hexagonal shape, an octagonal shape, etc.

As shown in FIG. 7 and FIG. 8, the light source substrate 2*a* is similar to the light source substrate 2 of the first example, and can be a printed circuit board, which has conductive wires. The configuration of the light source substrate 2*a* on the horizontal surface is approximately the same as that of the lens 1*a*, and is an annular shape, and has a light source portion opening 23*a* corresponding to the third opening 114*a*. The light source substrate 2*a* can be integrated or be formed by connecting a plurality of substrate units (not shown).

As shown in FIG. 7 and FIG. 8, the driving power component 4*a* is the same as or similar to the driving power component 4, which is not described herein. As shown in FIG. 8, similar to the light source module 100, the light source module 100*a* further includes the cover plate 5*a* mounted on the bottom of the power substrate 41*a*. The cover plate 5*a* can be made of a transparent insulating material, and is locked to the power substrate 41*a* by the second screw 62*a*. The plurality of light emitting units 3*a* of the present example are the same as the plurality of light emitting units 3, and will not be described in detail herein.

Figure 9:
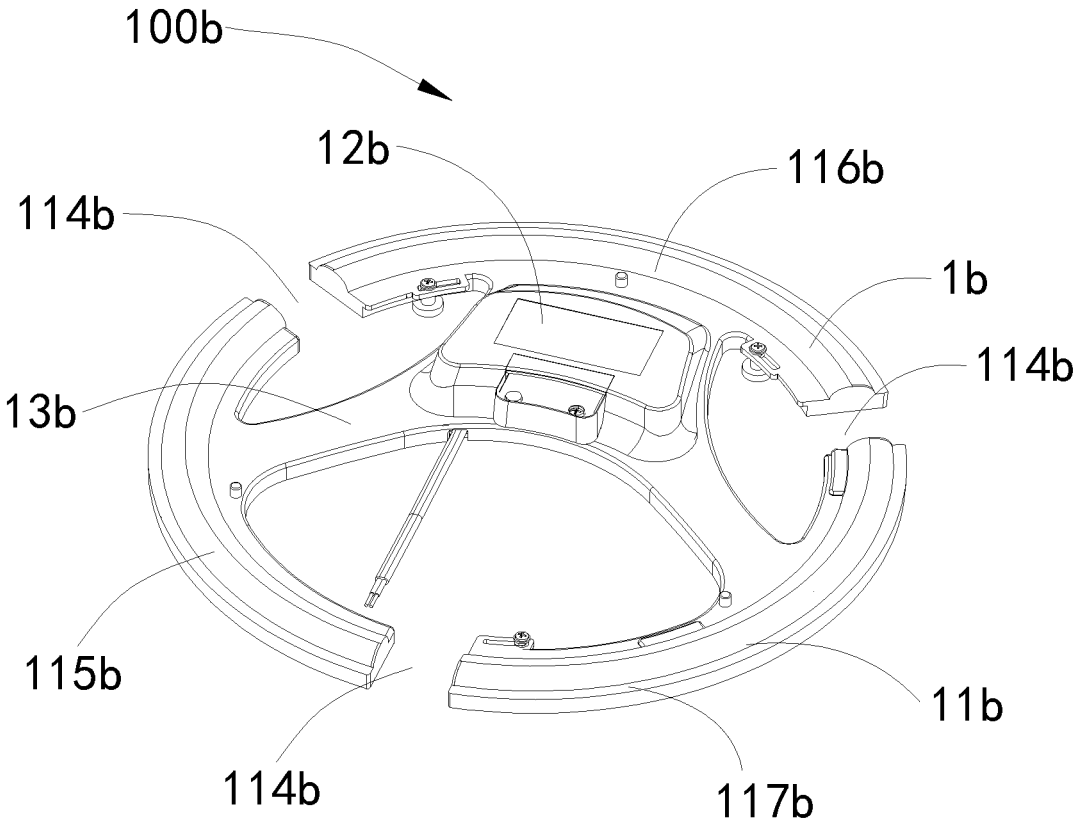
FIG. 9 is a perspective view of a light source module according to a third example of the present disclosure.
Figure 10:
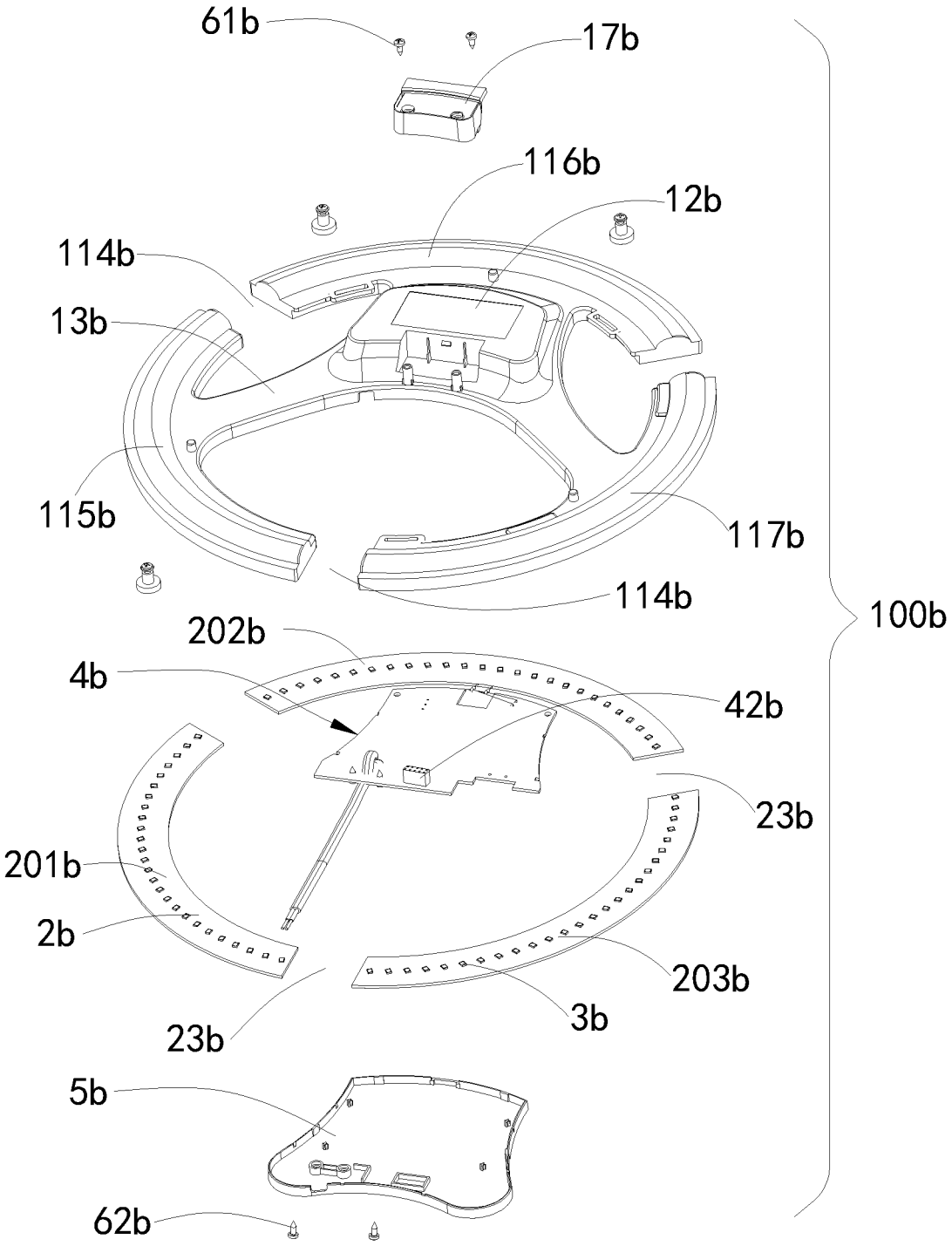
FIG. 10 is an exploded view of a light source module according to a third example of the present disclosure.

Referring to FIG. 9 and FIG. 10, a third example of the present disclosure provides a light source module 100*b* applied to a lighting device (not shown). The light source module 100*b* of the third example has substantially the same structure as the light source module 100 of the first example. Specifically, the light source module 100*b* includes a lens 1*b*, a light source substrate 2*b* assembled on a side of the lens 1*b*, a plurality of light emitting units 3*b* disposed on the light source substrate 2*b* and facing the lens 1*b*, and a driving power component 4*b* disposed in the middle of the lens 1*b*, a capping 17*b* connected to the lens 1*b* by a first screw 61*b* and a cover plate 5*b* connected to the lens 1*b* by a second screw 62*b*. Hereinafter, a difference between the light source module 100*b* and the light source module 100 will be described in detail.

As shown in FIG. 9 and FIG. 10, the lens 1*b* is substantially the same as the lens 1, and has a circular shape. The lens 1*b* includes an edge portion 11*b*, an intermediate portion 12*b* that is closely attached to the inner side of the edge portion 11*b*, and two connection portions 13*b* connecting the edge portion 11*b* and the intermediate portion 12*b*. Specifically, the edge portion 11*b* is matched with the light source substrate 2*b*, and the light source substrate 2*b* and the plurality of light emitting units 3*b* are provided below the edge portion 11*b*. The edge portion 11*b* is a light distribution portion that can distribute light beams emitted from the light emitting unit 3*b*. In the present example, the edge portions 11*b* includes three edge portions arranged at intervals and having a shape of an arc, such as a first edge portion 115*b*, a second edge portion 116*b*, and a third edge portion 117*b*. A third opening 114*b* is provided between two adjacent spaced edge portions. Of course, in other alternative examples, the first edge portion 115*b*, the second edge portion 116*b*, and the third edge portion 117*b* can also be joined end to end without setting intervals. The structure of the intermediate portion 12*b* of the lens 1*b* is the same as that of the intermediate portion 12 of the lens 1 in the first example, which is not be described herein. In addition, the shape of the lens 1*b* is merely illustrative, and is not limited to a circular shape, and can be an elliptical shape, a triangular shape, a square shape, a rectangular shape, a hexagonal shape, an octagonal shape, etc.

As shown in FIG. 9 and FIG. 10, the light source substrate 2*b* is similar to the light source substrate 2, and can be a printed circuit board, which has conductive wires. The configuration of the light source substrate 2*b* on the horizontal surface is approximately the same as that of the lens 1*b*, and is an annular shape, and has a light source portion opening 23*b* corresponding to the third opening 114*b*. Therefore, the light source substrate 2*b* can include a first light source substrate 201*b*, a second light source substrate 202*b*, and a third light source substrate 203*b*.

As shown in FIG. 9 and FIG. 10, the driving power component 4*b* is the same as or similar to the driving power component 4, and the light emitting unit 3*b* is the same as or similar to the light emitting unit 3, which is not described herein.

It should be noted that the light source module 100 can be applied to a lighting fixture (not shown), such as a ceiling lamp. After the lighting fixture is activated, light beams emitted from the light emitting unit 3 in the light source module 100 undergo a first outward refraction after passing through the light incident surface 112 of the edge portion 11 of the lens 1. The light extends along a straight line in the edge portion 11 of the lens 1. The light beams undergo a second outward refraction after reaching the light exiting surface 113. And after the two outward refractions, an illumination angle of the light source module 100 is increased. Because the illumination angle of the light source module 100 is increased, even in a case that there is no light emitting unit 3 installed at the middle position of the light source substrate 2, the middle region of the lighting fixture can have a certain brightness. Compared with the other examples, under the condition of maintaining the original brightness of the lighting fixture, the size of the light source substrate 2 carrying the light emitting units 3 in the light source module 100 can be reduced, and the number of the light emitting units 3 can also be reduced, thus reducing the manufacturing cost of the light source module 100. In addition, because the driving power source can be mounted on the light source substrate 2 of the light source module 100 and housed in the housing groove 1211 of the lens 1, the space of the light source substrate 2 of the light source module 100 is fully utilized, so that the light source module including the driving power source can be assembled as a module into the housing of the lighting fixture. In addition, because the light source module 100 can be firmly adsorbed on the ceiling lamp by the magnetic mounting element 15, so that the installation is convenient and the connection therebetween is reliable. At the same time, the lens 1 on the light source module 100 also serves as an electrically insulating housing, which improves a safety level.

In summary, the light source module provided by the present disclosure can still achieve an illumination region and an illumination effect, which are required by the lighting fixture, by expanding the illumination angle of the light source through the lens, while reducing the light emitting units, thus having the advantages of low cost and capability of achieving a certain illumination region and a certain illumination effect. At the same time, the lens has a housing region for the driving power source, and the structure of the lens is fully utilized. Therefore, the light source module having the lens and the driving power source can be assembled as a module into the housing of the lighting fixture, and be mounted on the ceiling lamp by the magnetic mounting element, so that the installation is convenient and the connection is reliable. Therefore, the light source module has the characteristics of easy installation, disassembly and replacement.

The present disclosure provides a light source module that is convenient to assemble.

According to one aspect of the present disclosure, a light source module is provided, which includes: an annular light source substrate; a plurality of light emitting units, disposed on a surface of the light source substrate; a driving power component, electrically connected with the light source substrate to supply power to the plurality of light emitting units, wherein the driving power component includes a power substrate and a plurality of electronic components disposed on at least one surface of the power substrate; and a light distribution element, including an annular optical portion covering the light source substrate and distributing light beams emitted from the plurality of light emitting units, and a drive housing portion housing the driving power component.

Further, the light source substrate is integrally or separately disposed with the power substrate.

Further, a lower surface of the optical portion is provided with a recessed groove housing the light source substrate and the plurality of light emitting units, a lower surface of the drive housing portion is provided with a housing groove housing the driving power component.

Further, the recessed groove includes a bottom surface appearing as an arched curved surface, the bottom surface is a light incident surface, the optical portion includes an upper surface appearing as an arched curved surface, the upper surface is a light exiting surface, a curvature of the light incident surface is greater than a curvature of the light exiting surface.

Further, the light source module further includes a controller housed in the housing groove, wherein the controller includes at least one of the group consisting of a timer, a switch for controlling the plurality of light emitting units, and a receiving element for receiving a signal from a remote controller or a control terminal.

Further, the light source substrate and the optical portion are in a snap-fit connection, the driving power component and the drive housing portion are in a snap-fit connection or in a fixed connection by a screw.

Further, the light source module further includes a cover plate, wherein the cover plate is connected with the drive housing portion.

Further, the light source module further includes a magnetic mounting element disposed in the housing region and assembled to the light distribution element.

According to another aspect of the present disclosure, a light source module is further provided, which includes: an annular light source substrate, enclosed to form a housing region; a plurality of light emitting units, disposed on a surface of the light source substrate; a driving power component, disposed in the housing region, and electrically connected with the light source substrate to supply power to the plurality of light emitting units, wherein the driving power component includes a power substrate and a plurality of electronic components disposed on at least one surface of the power substrate; and a light distribution element, including an annular optical portion covering the light source substrate and distributing light beams emitted from the plurality of light emitting units, a drive housing portion housing the driving power component and disposed in the housing region, and at least two connection portions connecting the drive housing portion to the optical portion, wherein the at least two connection portions divide the housing region into at least two separated spaces.

Further, the light source substrate and the optical portion are in a snap-fit connection, the light source substrate and the power substrate are electrically connected through a wire or an electrical connector.

Further, a lower surface of the optical portion is provided with a recessed groove housing the light source substrate and the plurality of light emitting units, a lower surface of the drive housing portion is provided with a housing groove housing the driving power component.

Further, the light source module further includes a cover plate, wherein the cover plate is connected with the drive housing portion and seals the housing groove.

Further, the light source module the magnetic mounting element includes a joint portion and an adsorption portion, the adsorption portion is a strong magnet and is housed in the joint portion.

Further, the light distribution element further includes a mounting portion disposed at an inner edge of the optical portion and extending into the housing region.

Further, the magnetic mounting element is position adjustably mounted on the mounting portion.

Further, the mounting portion extends from the inner edge of the optical portion into the housing region, or the mounting portion is disposed on the at least two connection portions.

Further, the mounting portion has a shape of an arc and is provided with a curved mounting hole, and the magnetic mounting element is locked to the mounting portion by a screw passing through the mounting hole, and a head of the screw and the adsorption portion are respectively located on both sides of the mounting portion.

According to still another aspect of the present disclosure, a light source module is further provided, which includes: an annular light source substrate, enclosed to form a housing region; a plurality of light emitting units, disposed on a surface of the light source substrate; a driving power component, disposed in the housing region, and electrically connected with the light source substrate to supply power to the plurality of light emitting units, wherein the driving power component includes a power substrate and a plurality of electronic components disposed on at least one surface of the power substrate; a light distribution element, detachably assembled with the light source substrate and the driving power component, respectively, and including an annular optical portion covering the light source substrate and distributing light beams emitted from the plurality of light emitting units, a drive housing portion housing the driving power component and disposed in the housing region, and at least two connection portions connecting the drive housing portion to the optical portion, wherein the at least two connection portions divide the housing region into at least two separated spaces.

Further, the light source substrate is integrally disposed with the power substrate.

Further, the light source substrate is separately disposed with the power substrate, the light source substrate and the power substrate are electrically connected through a wire or an electrical connector.

Further, the plurality of electronic components are disposed on both surfaces of the power substrate in a form of surface attaching or socketing.

Further, the light source module further includes a cover plate, wherein the cover plate is connected with the drive housing portion of the light distribution element, or the cover plate is connected with the drive housing portion and the optical portion of the light distribution element.

Further, a lower surface of the optical portion is provided with a recessed groove housing the light source substrate and the plurality of light emitting units, a lower surface of the drive housing portion is provided with a housing groove housing the driving power component.

Further, the recessed groove includes a bottom surface appearing as an arched curved surface, the bottom surface is a light incident surface, the optical portion includes an upper surface appearing as an arched curved surface, the upper surface is a light exiting surface, a curvature of the light incident surface is greater than a curvature of the light exiting surface.

Further, the light source module further includes a controller housed in the housing groove, wherein the controller includes a timer, a switch for controlling the plurality of light emitting units, and a receiving element for receiving a signal from a remote controller or a control terminal.

Further, the drive housing portion has a shape of a square and has at least two apical angle regions, the at least two connection portions extend from the apical angle regions of the drive housing portion to the optical portion.

Further, the light distribution element is a lens, the light source module further includes a light source substrate disposed in the at least two connection portions, a plurality of light emitting units are disposed on the light source substrate in the at least two connection portions, the at least two connection portions distribute light beams emitted from the plurality of light emitting units.

Further, the light source substrate has a shape of an integral circular ring, or the light source substrate includes at least two connected substrate units.

Further, the light source substrate and the optical portion are in a snap-fit connection, the driving power component and the drive housing portion are in a snap-fit connection or in a fixed connection by a screw.

Further, the light source module further includes a magnetic mounting element disposed in the housing region and assembled to the light distribution element.

Further, the light source module includes at least two magnetic mounting elements disposed in different separated spaces and assembled to the light distribution element.

Further, the light distribution element further includes a mounting portion disposed at an inner edge of the optical portion and extending into the housing region, the magnetic mounting element is position adjustably mounted on the mounting portion.

Further, the mounting portion is evenly arranged inside the optical portion.

Further, the mounting portion has a shape of an arc and is provided with a curved mounting hole, and the magnetic mounting element is locked to the mounting portion by a screw passing through the mounting hole, and a head of the screw and the magnetic mounting element are respectively located on both sides of the mounting portion.

Further, the magnetic mounting element includes a joint portion and an adsorption portion, one end of the joint portion is connected to the screw, and the other end of the joint portion houses the adsorption portion.

Further, the adsorption portion is a strong magnet.

According to still another aspect of the present disclosure, a lighting device is further provided, which includes the light source module provided by any one of the aforementioned examples, a chassis connected with the light source module, and a mask connected with the chassis, wherein the light source module is disposed in a space formed by the connection of the chassis and the mask.

Compared with the other examples, in the light source module of the present disclosure, the light source substrate and the driving power component are connected into an integrated structure through the light distribution element, thereby facilitating assembly and disassembly of the light source module in the lighting fixture The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The specific examples described above further illustrate objectives, technical solutions and beneficial effects of the present disclosure. It should be noted that, what have been described above are only specific implementations of the present disclosure, the protection scope of the present disclosure is not limited thereto. Therefore, any modifications, equivalents, improvements, etc., made within the spirit and the principles of the present disclosure, are intended to be included with the protection scope of the present disclosure.

What is claimed is:

1. A light source module, comprising:

an annular light source substrate;

a plurality of light emitting units disposed on a surface of the light source substrate;

a driving power component electrically connected with the light source substrate to supply power to the plurality of light emitting units, wherein the driving power component comprises a power substrate and a plurality of electronic components disposed on at least one surface of the power substrate;

a magnetic mounting element including a joint portion and an adsorption portion, wherein the adsorption portion is a strong magnet and is attached with the joint portion; and a light distribution element comprising an annular optical portion covering the light source substrate and distributing light beams emitted from the plurality of light emitting units, and a drive housing portion housing the driving power component.

2. The light source module according to claim 1, wherein the light source substrate is integrally or separately disposed with the power substrate.

3. The light source module according to claim 1, wherein a lower surface of the optical portion is provided with a recessed groove housing the light source substrate and the plurality of light emitting units, and a lower surface of the drive housing portion is provided with a housing groove housing the driving power component.

4. The light source module according to claim 3, wherein the recessed groove comprises a bottom surface appearing as an arched curved surface, the bottom surface is a light incident surface, the optical portion comprises an upper surface appearing as an arched curved surface, the upper surface is a light exiting surface, and a curvature of the light incident surface is greater than a curvature of the light exiting surface.

5. The light source module according to claim 3, further comprising a controller housed in the housing groove, wherein the controller comprises a set selected from the group comprising of a timer, a switch for controlling the plurality of light emitting units, and a receiving element for receiving a signal from a remote controller or a control terminal.

6. The light source module according to claim 1, wherein the light source substrate and the optical portion are in a snap-fit connection, the driving power component and the drive housing portion are in a snap-fit connection or in a fixed connection by a screw.

7. The light source module according to claim 1, further comprising a cover plate, wherein the cover plate is connected with the drive housing portion.

8. The light source module according to claim 1, wherein the light source substrate is enclosed to form a housing region, and magnetic mounting element is disposed in the housing region and is assembled to the light distribution element.

9. A light source module, comprising:

an annular light source substrate enclosed to form a housing region;

a plurality of light emitting units disposed on a surface of the light source substrate;

a driving power component disposed in the housing region and electrically connected with the light source substrate to supply power to the plurality of light emitting units, wherein the driving power component comprises a power substrate and a plurality of electronic components disposed on at least one surface of the power substrate;

a magnetic mounting element including a joint portion and an adsorption portion, wherein the adsorption portion is a strong magnet and is attached with the joint portion; and a light distribution element comprising an annular optical portion covering the light source substrate and distributing light beams emitted from the plurality of light emitting units, a drive housing portion housing the driving power component and disposed in the housing region, and at least two connection portions connecting the drive housing portion to the optical portion, wherein the at least two connection portions divide the housing region into at least two separated spaces.

10. The light source module according to claim 9, wherein the light source substrate and the optical portion are in a snap-fit connection, and the light source substrate and the power substrate are electrically connected through a wire or an electrical connector.

11. The light source module according to claim 9, wherein a lower surface of the optical portion is provided with a recessed groove housing the light source substrate and the plurality of light emitting units, and a lower surface of the drive housing portion is provided with a housing groove housing the driving power component.

12. The light source module according to claim 11, further comprising a cover plate, wherein the cover plate is connected with the drive housing portion and seals the housing groove.

13. The light source module according to claim 9, wherein the light distribution element further comprises a mounting portion that extends from the inner edge of the optical portion into the housing region, or the mounting portion is disposed on the at least two connection portions.

14. The light source module according to claim 13, wherein the magnetic mounting element is mounted on the mounting portion.

15. The light source module according to claim 14, wherein the magnetic mounting element is position adjustably mounted on the mounting portion.

16. The light source module according to claim 13, wherein the mounting portion is provided with a mounting hole, and the magnetic mounting element is locked to the mounting portion by a screw passing through the mounting hole, and a head of the screw and the adsorption portion are located on both sides of the mounting portion.

17. A light source module, comprising:

an annular light source substrate enclosed to form a housing region;

a plurality of light emitting units disposed on a surface of the light source substrate;

a driving power component disposed in the housing region and electrically connected with the light source substrate to supply power to the plurality of light emitting units, wherein the driving power component comprises a power substrate and a plurality of electronic components disposed on at least one surface of the power substrate;

a magnetic mounting element including a joint portion and an adsorption portion, wherein the adsorption portion is a strong magnet and is attached with the joint portion; and a light distribution element detachably assembled with the light source substrate and the driving power component, wherein the light distribution element comprises an annular optical portion covering the light source substrate and distributing light beams emitted from the plurality of light emitting units, a drive housing portion housing the driving power component and disposed in the housing region, and at least two connection portions connecting the drive housing portion to the optical portion, wherein the at least two connection portions divide the housing region into at least two separated spaces.

18. The light source module according to claim 17, wherein the light source substrate is integrally disposed with the power substrate.

19. The light source module according to claim 17, wherein the light source substrate is separately disposed with the power substrate, and the light source substrate and the power substrate are electrically connected through a wire or an electrical connector.

* * * * *